United States Patent [19]

Kuc

[11] 4,215,769

[45] Aug. 5, 1980

[54] WHEELED BAGGAGE HINGE SYSTEM

[76] Inventor: Anthony Kuc, 601 S. Providence Rd., Wallingford, Pa. 19063

[21] Appl. No.: 55,912

[22] Filed: Jul. 9, 1979

[51] Int. Cl.[3] ..... A45C 5/00; E05D 3/06

[52] U.S. Cl. ..... 190/18 A; 16/163; 16/47; 280/35

[58] Field of Search ..... 190/18 A, 18 R; 280/35, 280/37, 47.13, 79.2; 16/47, 190, 163, 18

[56] References Cited

U.S. PATENT DOCUMENTS

| | | | |
|---|---|---|---|
| 3,655,215 | 4/1972 | Becklin | 190/18 A |
| 3,805,929 | 4/1974 | Kuwayama | 190/18 A |
| 4,132,295 | 1/1979 | Hochfelsen | 16/163 |

*Primary Examiner*—Doris L. Troutman

*Attorney, Agent, or Firm*—Morton J. Rosenberg

[57] ABSTRACT

A wheeled baggage hinge system (10) adapted for use on a luggage carrier (12). The luggage carrier (12) is adapted for wheeled rotation on a base surface (16) and is further structurally defined to allow opening of lid element (18) and bottom element (20) on a base surface (16) in a manner such that lid sidewall (30) and bottom sidewall (34) lie in interfacing contact with the horizontal base surface (16) when luggage carrier (12) is opened. The wheeled baggage hinge system (10) includes a hinge mechanism (44) composed of a pair of bottom planar elements (52) and (54) rotatively coupled to a central planar element (56) which is pivotally mounted to each of bottom planar elements (52) and (54). The central planar element (56) includes an extended transverse length to allow non-interference of wheel elements (38) and (40) when lid element (18) and bottom element (20) are opened for interfacing contact with a base surface (16).

10 Claims, 6 Drawing Figures

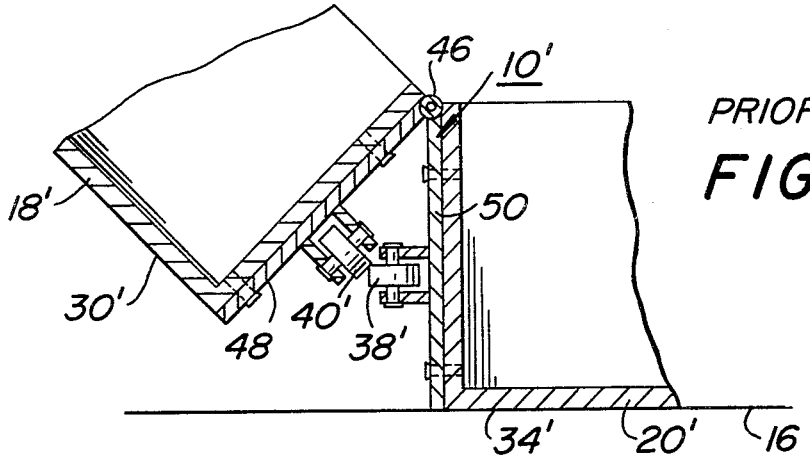
PRIOR ART
FIG. 4
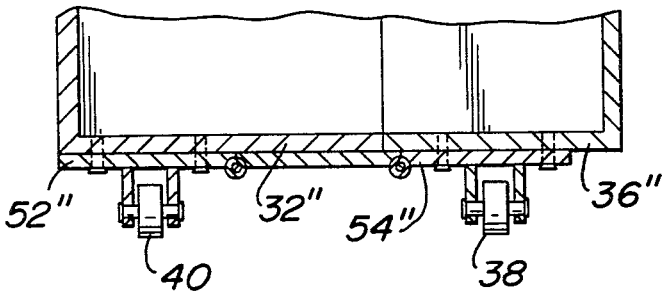
FIG. 5
FIG. 6
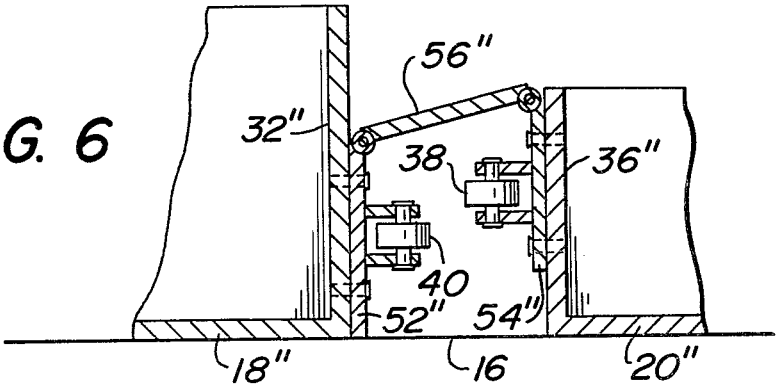

WHEELED BAGGAGE HINGE SYSTEM

BACKGROUND OF THE INVENTION

1. Field of the Invention

This invention pertains to baggage carrier systems. This invention further relates to luggage carrier systems which are adapted for being wheeled on a base surface. Still further, this invention pertains to a wheeled luggage carrier system to allow non-interference of wheel elements when the luggage carrier is opened to allow a lid element and a bottom element to interface with a horizontal base surface. Still further, this invention relates to a wheeled baggage hinge system which includes a hinge mechanism composed of a central planar member rotatively coupled on opposing ends to a pair of bottom wall planar elements which are respectively coupled to the lid element and bottom element of the luggage carrier.

2. Prior Art

Luggage carriers adapted for being wheeled on a base surface are known in the art. The best prior art known to Applicant includes U.S. Pat. Nos. 4,029,327; 3,842,953; 3,889,966; 2,919,138; 1,197,190; 3,735,996; 2,596,578; 3,655,215; 4,122,924; and, 1,895,677. In general, these prior art systems may provide for wheeled luggage carriers, however, it does not appear that any of the known prior art systems provide for a hinge-type mechanism of the type herein defined which allows for the opening of the halves of the luggage carrier into a flat condition on a base surface without interference of the wheel elements.

SUMMARY OF THE INVENTION

A wheeled baggage hinge system for coupling a luggage bag lid element and a bottom element in rotative displacement. The lid and bottom elements each have respective sidewall and bottom walls. There is included at least a pair of wheel elements which are secured respectively to a lower surface of the bottom walls of the lid and bottom elements. The wheel elements are substantially aligned each with respect to the other in a transverse direction. A luggage hinge mechanism is included which is secured to the bottom walls of the luggage lid and bottom elements for rotative displacement therebetween. The lid element and the bottom element are transversely displaced, each from the other by a distance sufficient to provide non-interference of the wheel elements when the lid and bottom sidewall elements are positionally located in contact interface with a substantially horizontal base surface. The wheel elements are secured to the luggage hinge mechanism.

BRIEF DESCRIPTION OF THE DRAWINGS

FIG. 4 is a sectional view of a prior art type wheeled luggage carrier, showing interference between wheel elements when the lid and bottom elements of the luggage carrier are in an open condition on a base surface;

FIG. 5 is a sectional view of an embodiment of the wheeled baggage hinge system, wherein the bottom walls are of differing lengths; and, FIG. 6 is a sectional view of the embodiment shown in FIG. 5, where the lid and bottom elements of the luggage carrier are in an open condition lying in a flat positional location on a base surface.

DESCRIPTION OF THE PREFERRED EMBODIMENTS

Figure 1:
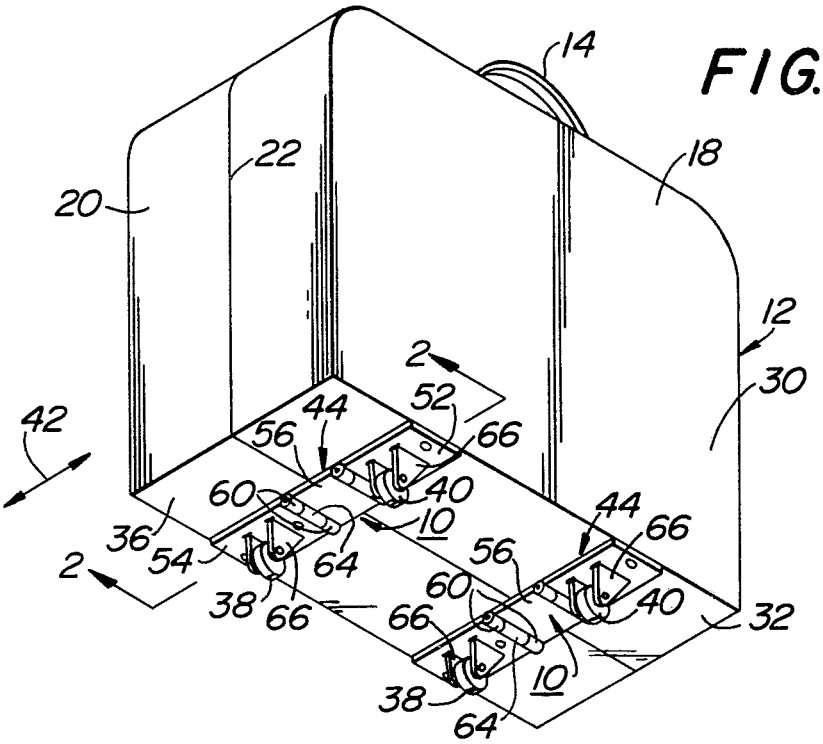
FIG. 1 is a perspective view of a luggage carrier containing the wheeled baggage hinge system.

Referring now to FIG. 1, there is shown wheeled baggage luggage hinge system 10 adapted for use on luggage carrier 12. Luggage carrier 12 includes handle 14 to be grasped by the user for lifting carrier 12 or guiding such in rolling contact on base surface 16, as is clearly shown in FIG. 3. As is inherent to the inventive concept, as is herein described, luggage carrier 12 is of the type adapted to be wheeled or otherwise guided on base surface 16 during use.

Figure 2:
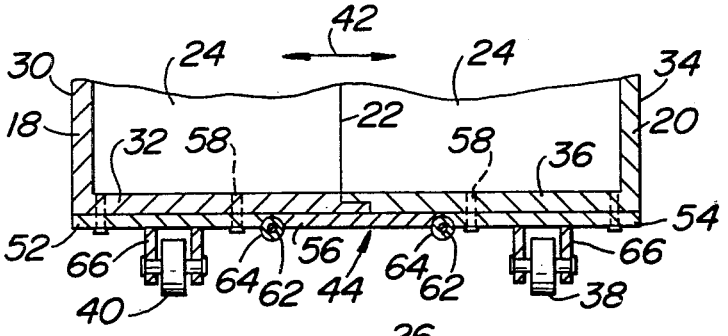
FIG. 2 is a cross-sectional view of the luggage carrier taken along the section line 2—2 of FIG. 1 when the luggage carrier is in a closed condition.
Figure 3:
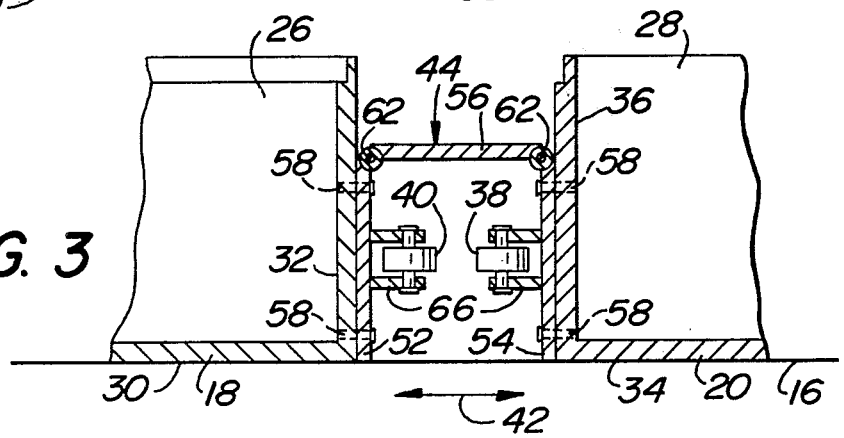
FIG. 3 is a sectional view partially cut away of the wheeled luggage carrier showing the lid elements and bottom element of the luggage carrier in an open condition while lying flat on a base surface.

Luggage carrier 12 includes luggage bag lid element 18 and luggage bag bottom element 20 adapted to interface along interface line 22 for providing enclosures 24 wherein material may be stored during transport. FIG. 2 is a cross-sectional view of luggage carrier 12 taken when bag lid element 18 and bag bottom element 20 are in closed or interfacing relation, as shown in FIG. 1. FIG. 3 is a cross-sectional view taken of bag lid element and bag bottom element 18 and 20 in an open relation on base surface 16, showing cavities 26 and 28 associated with elements 18 and 20, respectively, and providing for the basic purposes and objectives of wheeled baggage hinge system 10, as is herein described.

Luggage bag lid element 18 of luggage carrier 12 includes lid sidewall 30 and lid bottom wall 32, as shown in FIG. 2. Luggage bag bottom element 20 is composed of bottom sidewall 34 and bottom wall 36, as is shown in FIGS. 2 and 3 in the closed and open configurations, respectively.

Wheeled baggage hinge system 10 includes at least a pair of wheel elements 38 and 40 secured respectively to bottom wall 36 and lid bottom wall 32, as is shown in the Figures. Wheel elements 38 and 40 are aligned each with respect to the other in transverse direction 42.

Baggage hinge system 10 further includes luggage hinge mechanism 44 which is secured to bottom walls 36 and 32 for rotative displacement therebetween. Lid element 18 and bottom element 20, as is shown in FIG. 3, are transversely displaced each from the other by a distance sufficient to provide non-interference of wheel elements 38 and 40 when lid element and bottom element 18 and 20 are positionally located in contact interface with substantially horizontal base surface 16. Referring to FIG. 4, there is seen a prior art wheeled baggage hing system 10' which shows the structural disadvantages when lid elements 18' and 20' are positionally located on base surface 16. Wheel elements 38' and 40' are transversely aligned and mounted to prior art planar members 48 and 50. Planar members 48 and 50 are pivotally coupled to pivotal hinge 46 at the center line or interface line between lid element 18' and bottom element 20'. As can be seen, when lid elements 18' and bottom element 20' are opened for location on base surface 16, wheel elements 38' and 40' interface and contact each other prior to luggage bag lid element 18' being opened a sufficient amount such that lid sidewall 30' would interface base surface 16. This has the effect of causing undue stress considerations on the structural elements of hinge system 10', as well as providing an inconvenience for the user when unpacking or packing elements 18' and 20'. It is specifically this contact interference between wheel elements 38' and 40' which evolved into the invention of wheeled baggage hinge system 10, as provided in FIGS. 1—3.

Hinge mechanism 44 includes a pair of bottom wall planar elements 52 and 54, which are secured respectively to bottom walls 32 and 36 of luggage bag bottom elements 18 and 20. Bottom wall planar elements 52 and 54 are generally rectangular in contour and formed of either plastic, metal or some like material not important to the inventive concept as is herein described, with the exception that such are sufficient in structural strength to accept structural loads placed thereon in the normal course of the use of luggage carrier 12. Bottom wall planar elements 52 and 54 are secured to lid bottom walls 32 and bottom wall 36 through bolts, screws, or like elements 58 as is shown in FIGS. 1—3.

Hinge mechanism 44 further includes central planar element 56 extending in transverse direction 42 between planar elements 52 and 54. Central planar element 56 is pivotally coupled to bottom wall planar elements 52 and 54 on opposing ends thereof. As can be seen, lid element 18 and bottom element 20 are pivoted each with respect to the other about an axis line substantially normal transverse direction 42. Bottom wall planar elements 52 and 54 include sleeve elements 60 having a through opening for insert of pivot pin 62. Central planar element 56 includes sleeve element 64 having a through opening and is rotatively cooperative with sleeve elements 60 formed on bottom wall planar elements 52 and 54. In this manner, lid and bottom elements 18 and 20 of luggage carrier 12 may be rotatively displaced to an open condition as provided in FIG. 3.

As can be seen in FIG. 3, wheel elements 38 and 40 are secured to planar elements 52 and 54 in rotative displacement. Each of wheel elements 38 and 40 extend from bottom wall planar elements 52 and 54 by a predetermined transverse distance, as is shown in FIG. 3. In order to provide non-interference between wheel elements 38 and 40 when elements 18 and 20 are positionally located in an open condition on base surface 16, central planar element 56 extends in transverse direction 42 by an amount which is substantially equal to or greater than the sum of the predetermined distance extensions of wheel elements 38 and 40 from bottom wall planar elements 52 and 54. In this manner, opposing elements 18 and 20 may be fully opened and sidewalls 34 and 30 may contact horizontal base surface 16 for insert or removal of material contained within cavities 26 and 28.

Wheel elements 38 and 40 may be mounted in rotative displacement to a pair of flange elements 66, as is shown. Flange elements 66 are mounted on opposing sides of wheel elements 38 and 40 and in themselves are secured to bottom wall planar elements 52 and 54 through welding, or some like technique.

Referring now to FIGS. 5 and 6, there is shown an embodiment of the overall wheeled baggage hinge system 10 where bottom wall 36" and lid bottom wall 32" are not of equal length. In this particular situation, dependent upon a predetermined luggage carrier 12 being utilized, it is seen that bottom wall planar element 54" is shorter in overall extension than bottom planar wall element 52". In this embodiment, when opposing elements 18" and 20" are placed in an open condition on base surface 16, central planar element 56" is formed into an obtuse angle between central planar element 56" and at least one of bottom wall planar elements 52" or 54". The only consideration of importance to the inventive concept in this embodiment is that the horizontal transverse displacement between walls 32" and 36" be either equal to or greater than the extended length of wheel elements 38 and 40 from planar elements 52" and 54". This transverse distance allows for non-interference between wheel elements 38 and 40, as has hereinbefore been described.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A wheeled baggage hinge system for coupling a luggage bag lid element and a bottom element in rotative displacement, said lid and bottom elements each having a respective sidewall and bottom wall comprising:

(a) at least a pair of wheel elements secured respectively to a lower surface of said bottom walls of said lid and bottom elements, said wheel elements being substantially aligned each with respect to the other in a transverse direction; and, (b) luggage hinge means secured to said bottom walls of said luggage lid and bottom elements for rotative displacement therebetween, said lid element and said bottom element being transversely displaced each from the other by a distance sufficient to provide non-interference of said wheel elements when said lid and bottom sidewall elements are positionally located in contact interface with a substantially horizontal base surface, said wheel elements being secured to said luggage hinge means.

2. The wheeled luggage hinge system as recited in claim 1 where said luggage hinge means includes:

(a) a pair of bottom wall planar elements secured to said bottom walls of said luggage bag bottom elements; and, (b) a central planar element extending in said transverse direction, said central planar element being pivotally coupled to said pair of bottom wall planar elements on opposing ends thereof.

3. The wheeled luggage hinge system as recited in claim 2 where said lid element and said bottom element are pivoted each with respect to the other about an axis line substantially normal said transverse direction.

4. The wheeled luggage hinge system as recited in claim 3 where said luggage hinge means includes a pivot pin element extending through rotatively cooperating and aligned sleeve elements formed on said bottom wall planar elements and said central planar element.

5. The wheeled luggage hinge system as recited in claim 2 where said wheel elements are rotatively coupled to each of said bottom wall planar elements, each of said wheel elements extending from said bottom wall planar elements by a predetermined distance.

6. The wheeled luggage hinge system as recited in claim 5 where said central planar element extends in said transverse direction by an amount substantially equal to the sum of said predetermined distance extensions of said wheel elements.

7. The wheeled luggage hinge system as recited in claim 5 where said central planar element extends in said transverse direction by an amount greater than the sum of said predetermined distance extensions of said wheel elements.

8. The wheeled luggage hinge system as recited in claim 1 where said wheel elements are rotatively coupled to a pair of flange elements, said flange elements being secured to said bottom wall planar elements.

9. The wheeled luggage hinge system as recited in claim 2 where said pair of bottom wall planar elements are of unequal transverse length.

10. The wheeled luggage hinge system as recited in claim 9 where said central planar element is rotatively coupled to said pair of bottom wall planar elements for providing an obtuse angle between said central planar element and one of said bottom wall planar elements when said bottom and sidewall elements are in said contact interference with said substantially horizontal base surface.

* * * * *